US007267500B2

(12) United States Patent
Tsuchiya et al.

(10) Patent No.: US 7,267,500 B2
(45) Date of Patent: Sep. 11, 2007

(54) PRINTER APPARATUS

(75) Inventors: Masahiro Tsuchiya, Shinagawa (JP); Yukihiro Mori, Shinagawa (JP); Sumio Watanabe, Shinagawa (JP)

(73) Assignee: Fujitsu Component Limited, Tokyo (JP)

( * ) Notice: Subject to any disclaimer, the term of this patent is extended or adjusted under 35 U.S.C. 154(b) by 164 days.

(21) Appl. No.: 10/865,949

(22) Filed: Jun. 14, 2004

(65) Prior Publication Data

US 2005/0207818 A1 Sep. 22, 2005

(30) Foreign Application Priority Data

Mar. 22, 2004 (JP) ..... 2004-083273

(51) Int. Cl.
*B41J 11/00* (2006.01)

(52) U.S. Cl. ..... 400/621; 83/679

(58) Field of Classification Search ..... 400/621; 83/679

See application file for complete search history.

(56) References Cited

U.S. PATENT DOCUMENTS 5,735,185 A * 4/1998 Kondo et al. ..... 83/611
5,833,380 A * 11/1998 Hosomi et al. ..... 400/621

FOREIGN PATENT DOCUMENTS

| | | |
|---|---|---|
| JP | 2000-094767 | 4/2000 |
| JP | 2000-118060 | 4/2000 |
| JP | 2003-225887 | 8/2003 |

* cited by examiner

*Primary Examiner*—Daniel J. Colilla
*Assistant Examiner*—Marissa Ferguson-Samreth
(74) *Attorney, Agent, or Firm*—Staas & Halsey LLP

(57) ABSTRACT

A printer apparatus includes a first module including a fixed blade, and a second module being detachably attached to the first module, the second module including a movable blade, wherein the fixed blade includes an overlap portion and the movable blade includes an overlap portion overlapping with the overlap portion of the fixed blade when the first and second modules are detachably attached, and wherein at least one of the overlap portion of the movable blade and the overlap portion of the fixed blade has an inclination portion, which inclination portion in the case of the overlap portion of the movable blade inclines away from the fixed blade, and in the case of the overlap portion of the fixed blade inclines away from the movable blade.

10 Claims, 18 Drawing Sheets

PRINTER APPARATUS

BACKGROUND OF THE INVENTION

1. Field of the Invention

The present invention generally relates to a printer apparatus, and more particularly to a thermal printer apparatus having a first module detachably attached to a second module in which a fixed blade in the first module and a movable blade in the second module together form a cutter for cutting a paper printed by the printer apparatus.

2. Description of the Related Art

A thermal printer apparatus having a function of automatically cutting a continuing sheet of paper is, in general, mounted to portable terminals such as a POS terminal or a ticketing terminal.

A conventional thermal printer apparatus having an automatic sheet cutting function has a thermal printer main body including a thermal head, a platen, and a motor, wherein the thermal printer main body is attached to a separate cutter apparatus. The cutter apparatus has a fixed blade, a movable blade, and a motor for moving the movable blade.

In many conventional thermal printer apparatuses, the height of the thermal printer main body is required to match with that of the cutter apparatus, which causes difficulty in forming a thin sized thermal printer apparatus. Therefore, the demand for a thin sized portable terminal could not be satisfied.

Under this circumstance, the applicant of the present application proposed a thermal printer apparatus 10 having a cutter part, wherein a first module 11 is detachably attached to a second module 20. FIGS. 1A through 1C are schematic drawings showing the thermal printer apparatus 10. FIG. 1A shows a state where the second module 20 is separated from the first module 11. FIG. 1B is a side view of the thermal printer apparatus 10 having the second module 20 attached to the first module 11, and FIG. 1C is a plan view of the thermal printer apparatus 10 having the second module 20 attached to the first module 11. As shown in FIG. 1C, X1-X2 indicates the width direction of the thermal printer apparatus 10. As shown in FIGS. 1A and 1B, Y1-Y2 indicates the length (longitudinal) direction of the thermal printer apparatus 10, and Z1-Z2 indicates the height direction of the thermal printer apparatus 10. The first module 11 includes a thermal head 12, a head-urging planar spring member 13, a fixed blade 14, a blade-urging planar spring member 15, a lock member 16, and a pulse motor (not shown). The lock member 16 is urged in a clockwise direction by a spring member. The second module 20 includes a platen roller 21 and a movable blade 22. The fixed blade 14 and the movable blade 22 together form a cutter 30 (FIGS. 1B and 1C), which is referred in greater detail below. As shown in FIG. 1C, the fixed blade 14 has a straight shaped blade part 14*a*, and the movable blade 22 has a V-shaped blade part 22*a*. In addition, finger parts 22*b*, 22*c* are disposed on both ends of the blade part 22*a*.

The first module 11 is attached to a main body of a portable terminal, and the second module 20 is attached to a rotatable openable lid. In a final stage of rotating and closing the lid, the lock member 16 is temporarily depressed. When the lid is completely closed, an axis 23 of the platen roller 21 becomes engaged with the lock member 16, the second module 20 becomes coupled to the first module 11, and the platen roller 21 abuts the thermal head 12, thereby obtaining an initial state of the cutter 30 in which the finger parts 22*b*, 22*c* of the movable blade 22 overlap with an upper part of the fixed blade 14, as shown in FIGS. 1B and 1C. In the final stage of closing the lid, the finger parts 22*b*, 22*c* contact against the fixed blade 14 to cause the fixed blade 14 to flex the blade-urging planar spring member 15 and to move toward direction Z2. In this state, the urging force generated by the blade-urging planar spring member 15 serves as a force required for cutting paper disposed between the movable blade 22 and the fixed blade 14.

That is, the movable blade 22 is moved to a position where the fixed blade 14 is depressed against the blade-urging planar spring member 15, so that the axis 23 of the platen roller 21 becomes engaged with the lock member 16. This procedure of closing the lid of the portable terminal requires an inconvenient operation of firmly applying a considerable amount of force F1 to the lid.

Furthermore, in a case where the lid is inadvertently closed in an incomplete manner, the axis 23 of the platen roller 21 cannot sufficiently engage with the lock member 16. This may cause the lid to undesirably open during operation of the thermal printer apparatus 10.

SUMMARY OF THE INVENTION

It is a general object of the present invention to provide a printer apparatus that substantially obviates one or more of the problems caused by the limitations and disadvantages of the related art.

Features and advantages of the present invention will be set forth in the description which follows, and in part will become apparent from the description and the accompanying drawings, or may be learned by practice of the invention according to the teachings provided in the description. Objects as well as other features and advantages of the present invention will be realized and attained by a printer apparatus particularly pointed out in the specification in such full, clear, concise, and exact terms as to enable a person having ordinary skill in the art to practice the invention.

To achieve these and other advantages and in accordance with the purpose of the invention, as embodied and broadly described herein, the invention provides a printer apparatus including: a first module including a fixed blade; and a second module being detachably attached to the first module, the second module including a movable blade; wherein the fixed blade includes an overlap portion and the movable blade includes an overlap portion overlapping with the overlap portion of the fixed blade when the first and second modules are detachably attached, and wherein at least one of the overlap portion of the movable blade and the overlap portion of the fixed blade has an inclination portion, which inclination portion in the case of the overlap portion of the movable blade inclines away from the fixed blade, and in the case of the overlap portion of the fixed blade inclines away from the movable blade.

In the printer apparatus according to an embodiment of the present invention, the inclination portion may be formed by bending.

In the printer apparatus according to an embodiment of the present invention, the inclination portion may be formed by chamfering.

In the printer apparatus according to an embodiment of the present invention, the inclination portion may be formed by grinding.

In the printer apparatus according to an embodiment of the present invention, a gap may be provided between the overlap portion of the movable blade and the overlap portion of the fixed blade.

In the printer apparatus according to an embodiment of the present invention, the overlap portion of the fixed blade may have the inclination portion, and the inclination portion may incline away from the movable blade.

In the printer apparatus according to an embodiment of the present invention, the overlap portion of the movable blade may have the inclination portion, and the inclination portion may incline away from the fixed blade.

In the printer apparatus according to an embodiment of the present invention, the overlap portion of the fixed blade and the overlap portion of the movable blade each may have an inclination portion, wherein the inclination portion of the fixed blade may incline away from the movable blade, and the inclination portion of the movable blade may incline away from the fixed blade.

Furthermore, the present invention provides a printer apparatus including: a first module including a fixed blade; and a second module being detachably attached to the first module, the second module including a movable blade; wherein, when the first and second modules are detachably attached, the movable blade is movable with respect to the fixed blade from a first position at which the movable blade is spaced from the fixed blade and a second position at which the movable blade contacts the fixed blade and cooperates with a spring force exerted by the fixed blade to generate a blade force.

In the printer apparatus according to an embodiment of the present invention, the pressing force required to attach the second module to the first module may be unimpeded by the spring force exerted by the fixed blade.

Other objects and further features of the present invention will be apparent from the following detailed description when read in conjunction with the accompanying drawings.

DESCRIPTION OF THE PREFERRED EMBODIMENTS

In the following, embodiments of the present invention will be described with reference to the accompanying drawings.

Figure 1A:
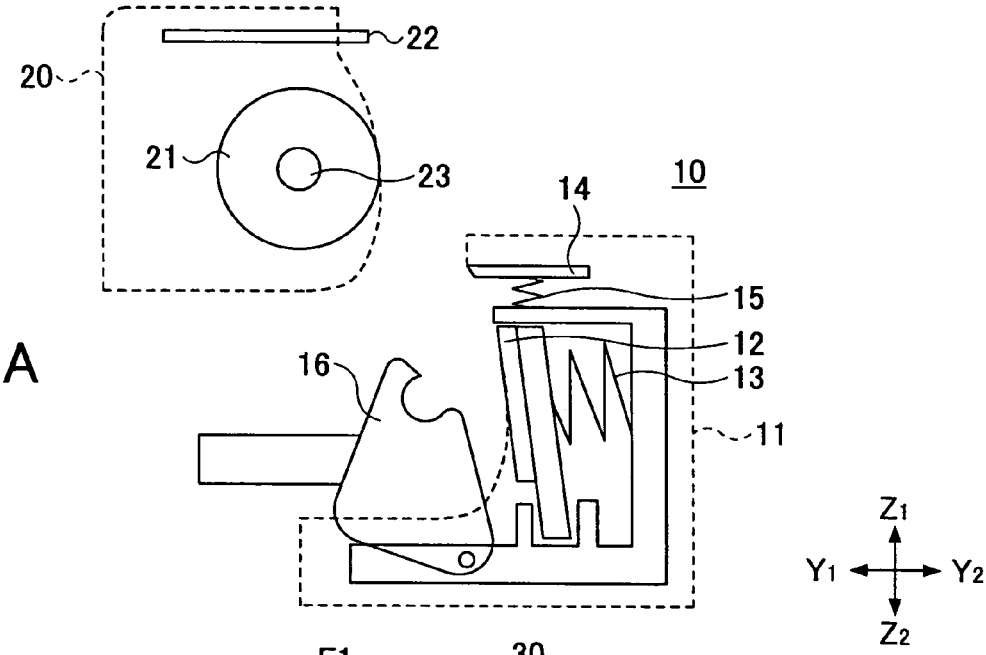
FIGS. 1A through 1C are schematic drawings showing a conventional thermal printer apparatus.
Figure 1B:
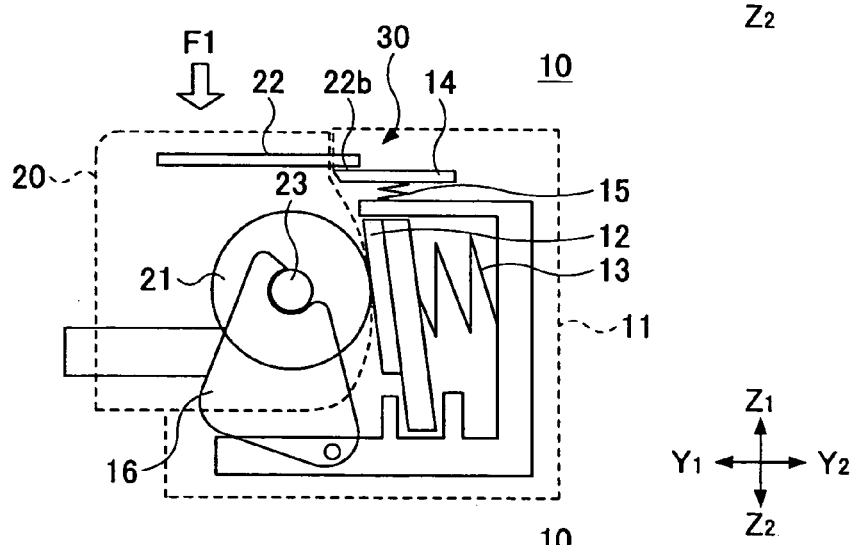
Figure 1C:
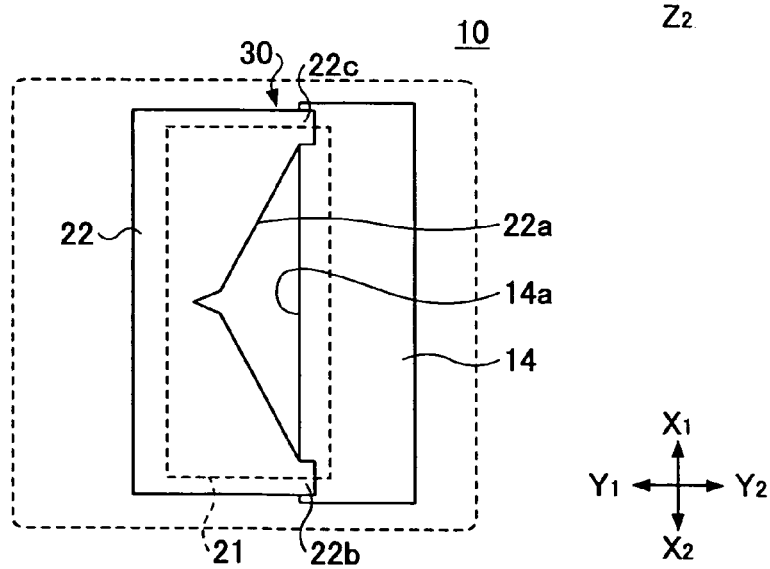
Figure 2:
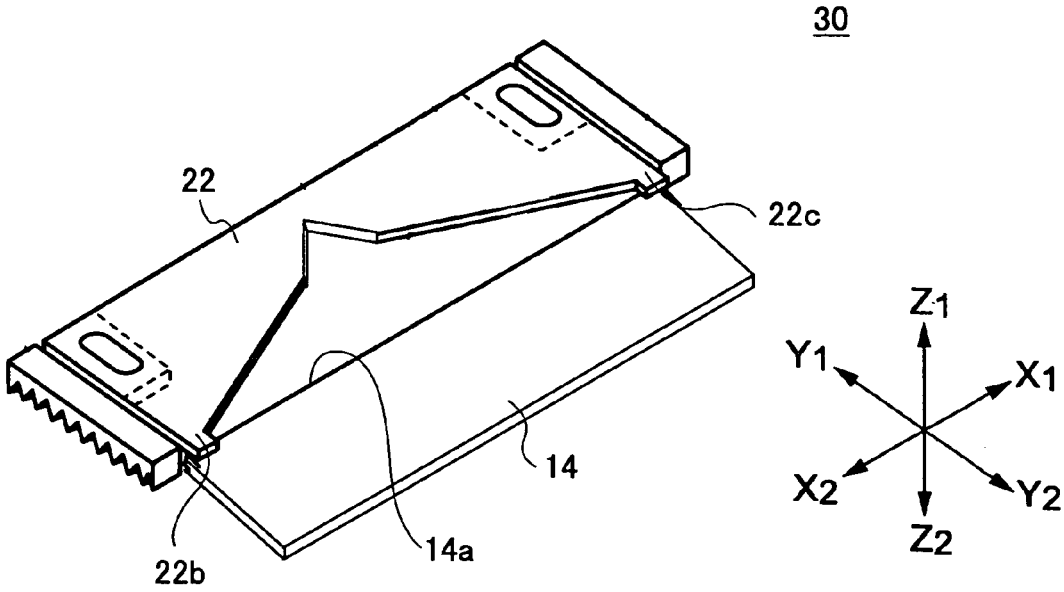
FIG. 2 is a perspective view showing a conventional cutter.
Figure 3:
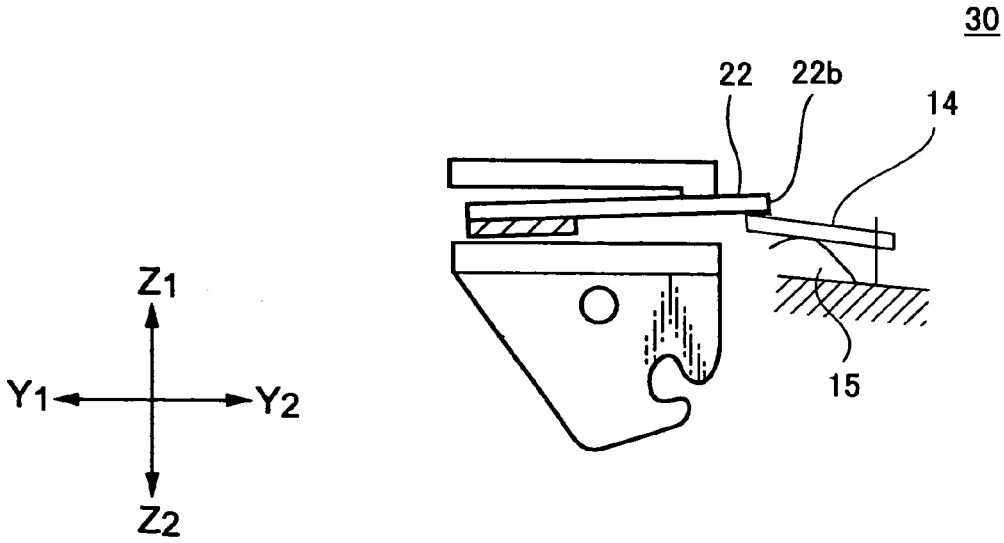
FIG. 3 is a side view showing a conventional cutter.
Figure 4:
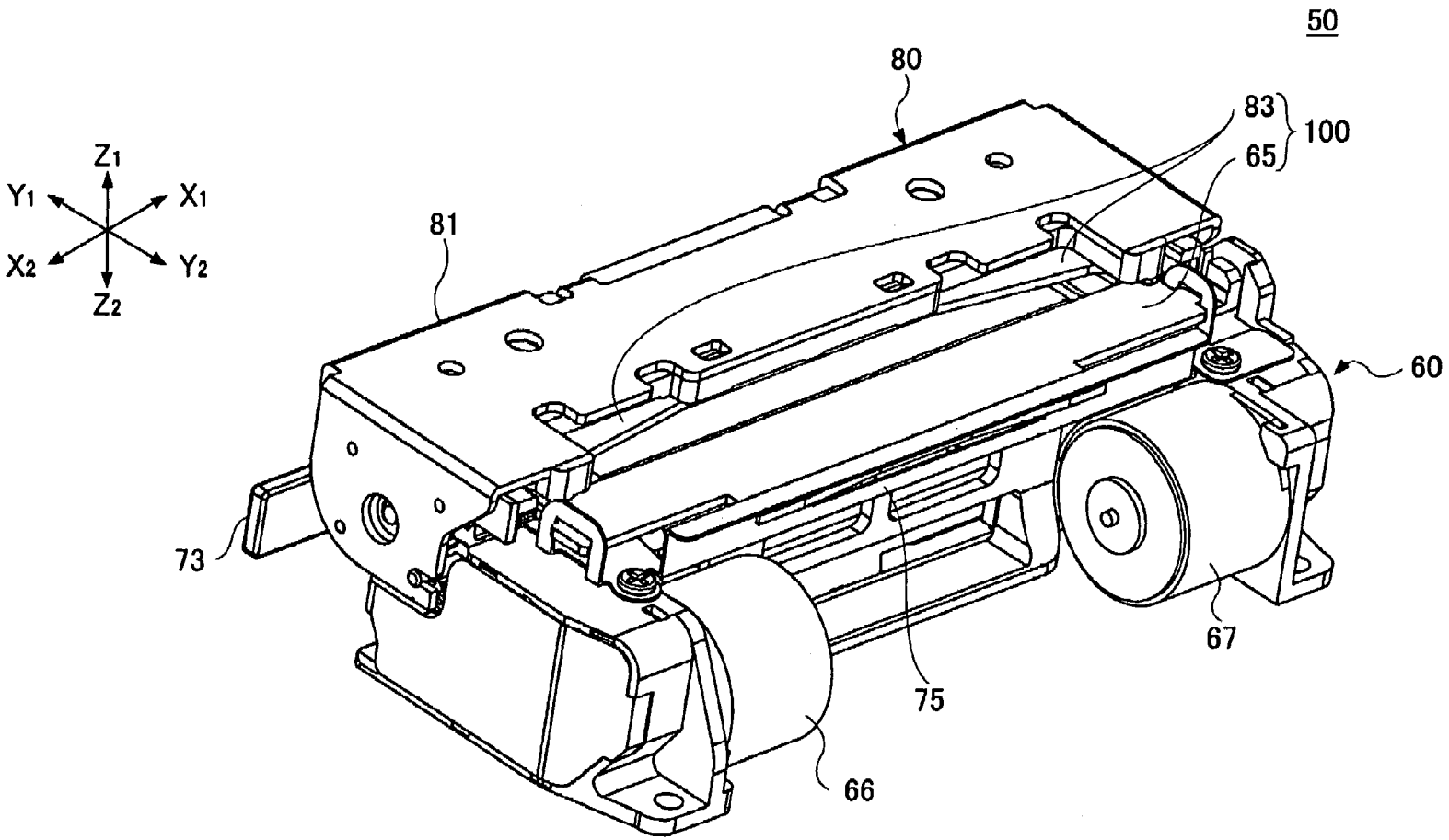
FIG. 4 is a perspective view showing a thermal printer apparatus according to an embodiment of the present invention.
Figure 5:
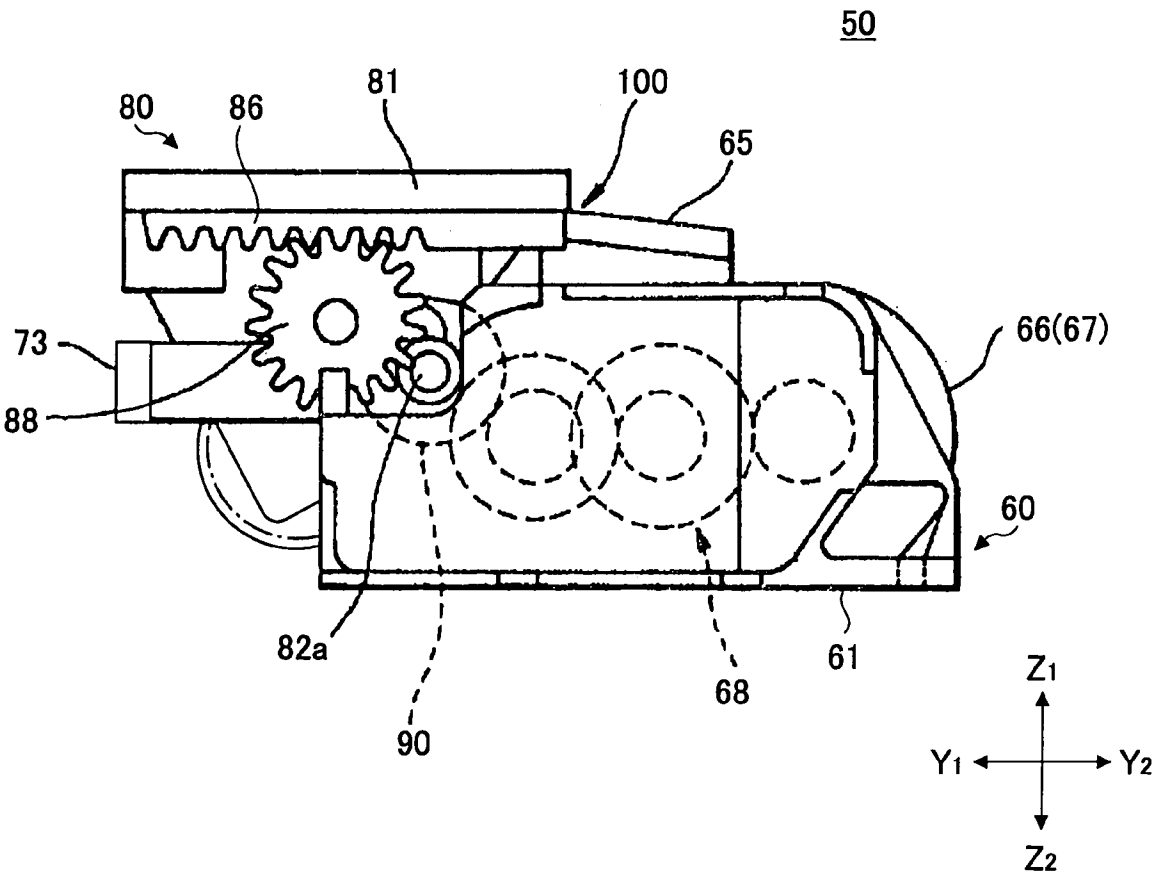
FIG. 5 is a side view showing the thermal printer apparatus shown in FIG. 4.

FIGS. 4 and 5 are drawings showing a thermal printer apparatus 50 according to a first embodiment of the present invention. The thermal printer apparatus 50 is a printer of a line printing type and is also of a clamshell type. X1-X2 indicates a width direction of the thermal printer apparatus 50, Y1-Y2 indicates a longitudinal direction of the thermal printer apparatus 50, and Z1-Z2 indicates a height direction of the thermal printer apparatus 50.

Figure 7A:
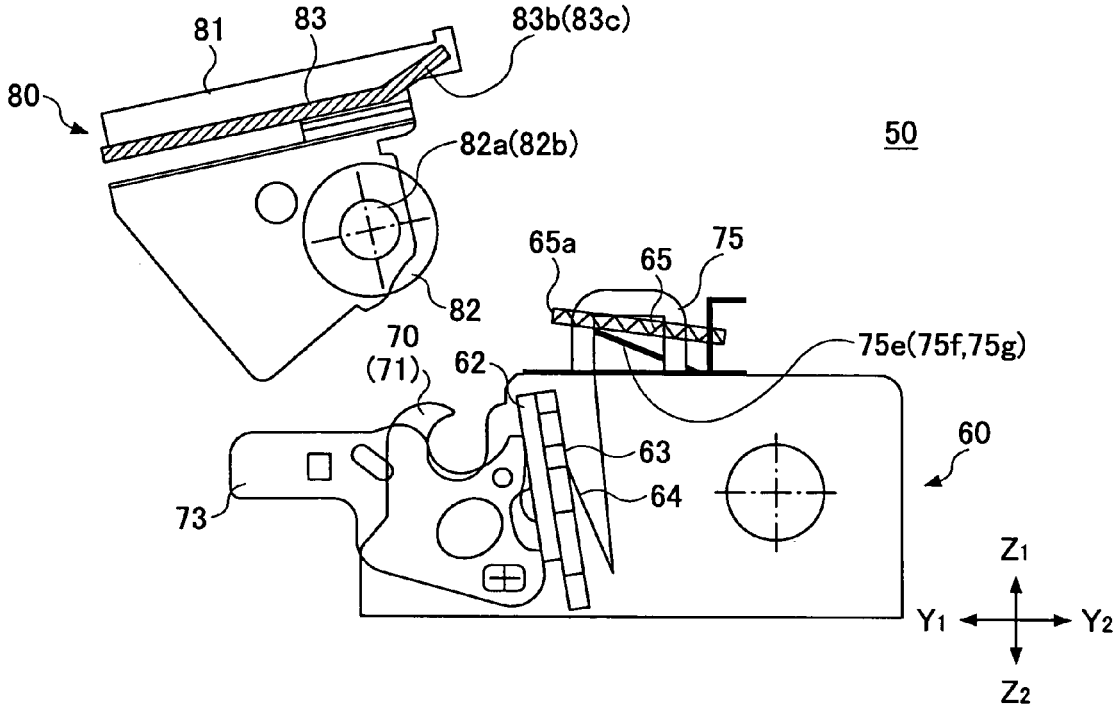
FIGS. 7A and 7B are schematic drawings showing a cutter of the thermal printer apparatus obtained by locking a second module to a first module.
Figure 7B:
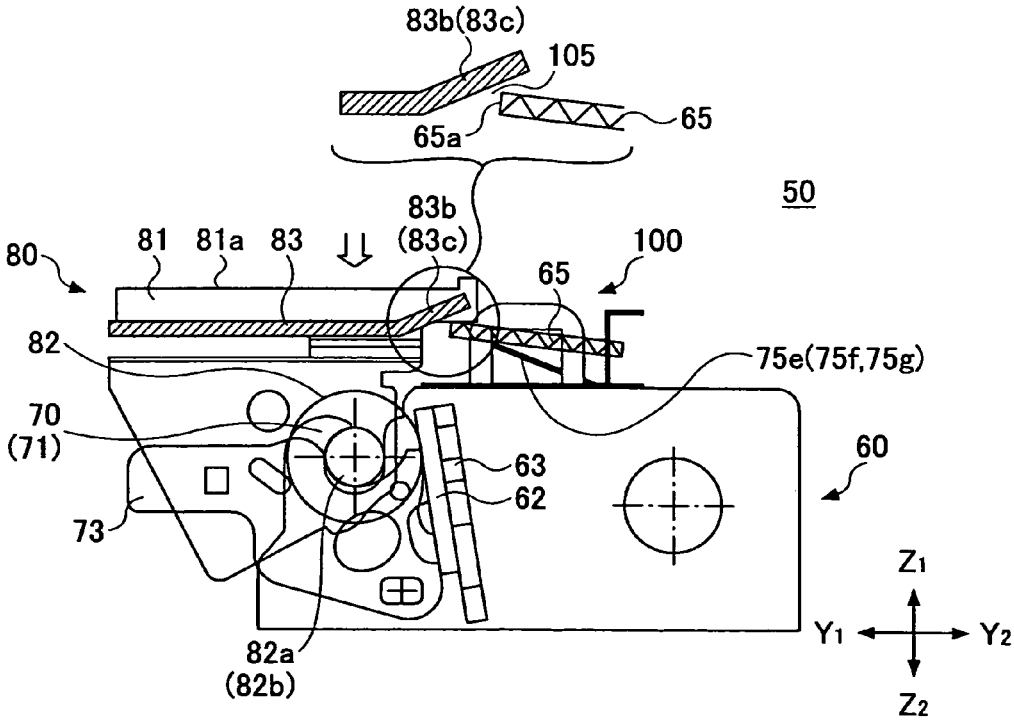

The thermal printer apparatus 50 has a first module 60 (see FIG. 9) and a second module 80 (see FIG. 11) which are detachably attached in a manner such as that shown in FIGS. 7A and 7B, for example. In the attached state of the first module 60 and the second module 80, a cutter 100 (described below) is situated more downstream in a sheet conveying direction than a position where printing is performed.

Figure 9:
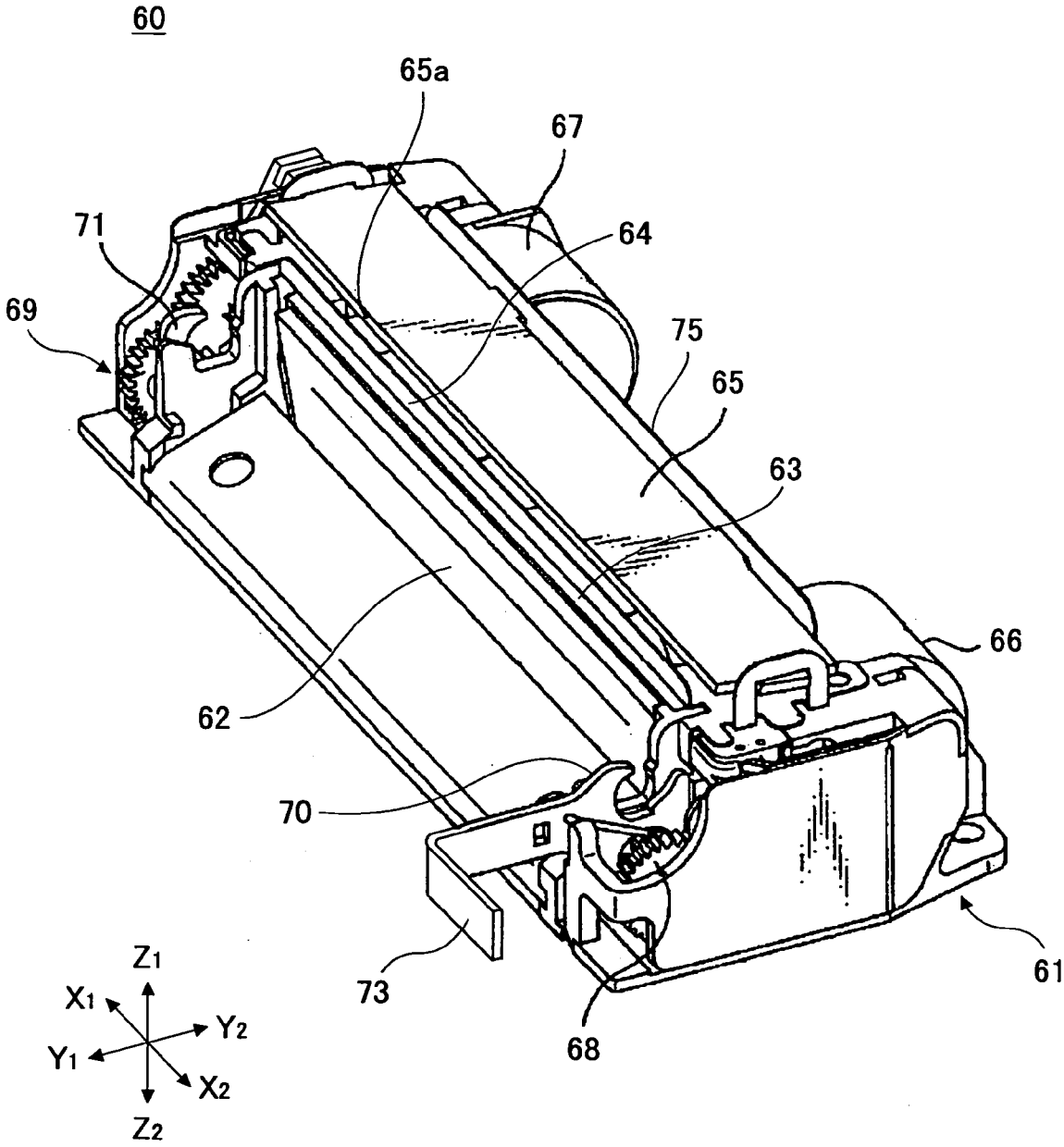
FIG. 9 is a perspective view showing a first module of the thermal printer apparatus according to an embodiment of the present invention.

As shown in FIG. 9, the first module 60 includes a first support member 61 to which a thermal head 62, a thermal head support member 63, a head-urging planar spring member 64, a fixed blade 65, a first pulse motor 66, a second pulse motor 67, a first gear train 68, a second gear train 69, lock members 70, 71, and an operation knob 73, for example, are attached.

Figure 8A:
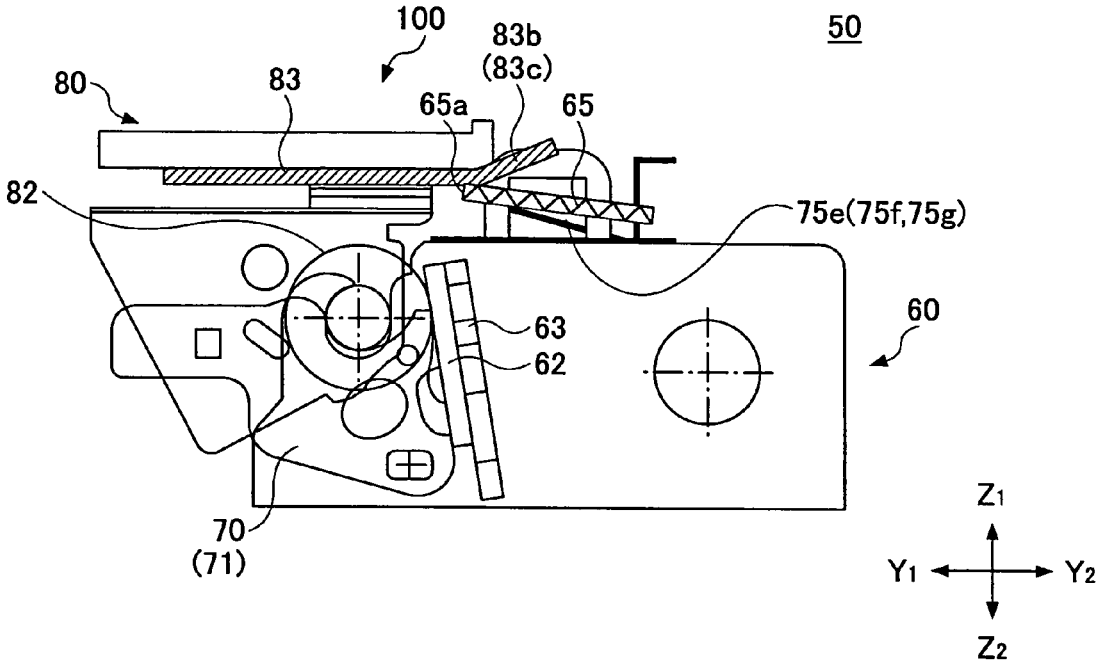
FIGS. 8A and 8B are schematic drawings for explaining the movement of a cutter of the thermal printer apparatus according to an embodiment of the present invention.
Figure 8B:
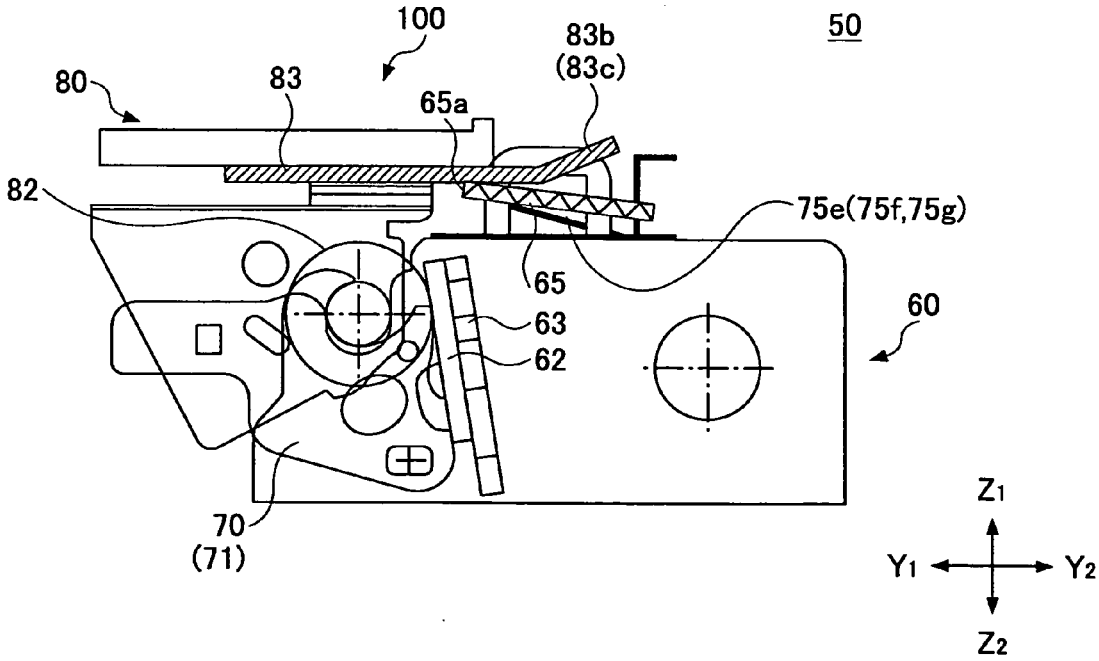
Figure 10:
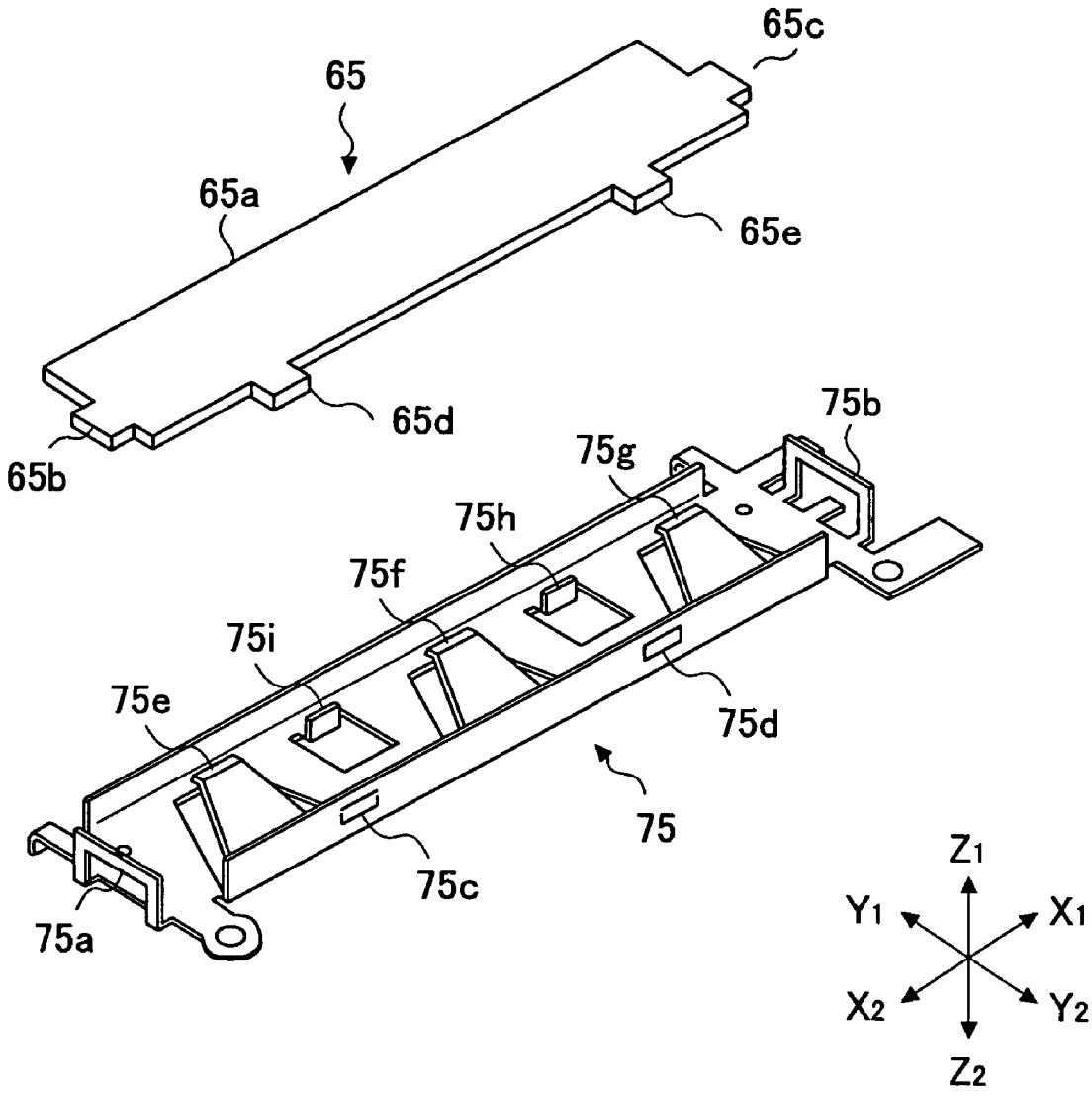
FIG. 10 is an exploded perspective view showing a fixed blade and a support member of the FIG. 9 module of the thermal printer apparatus.

As shown in FIG. 10, the fixed blade 65, being formed in a planar shape, includes a blade part 65*a*, protrusion parts 65*b*, 65*c* protruding in directions X1 and X2, and protrusion parts 65*d*, 65*e* protruding in direction Y2. The fixed blade 65 is attached to a support member 75, in which the protrusion parts 65*b* through 65*e* of the fixed blade are engaged with respective slot parts 75*a* through 75*d* of the support member 75. The support member 75 is screwed to the first support member 61 (see FIG. 9). The support member 75 is made of a thin metal plate that is formed by press molding. The support member 75 includes planar spring parts 75*e* through 75*g*, and support pieces 75*h*, 75*i* which are formed by being cut and lifted in direction Z1. The fixed blade 65 is supported by the support pieces 75*h*, 75*i*, and is urged by the planar spring parts 75*e* through 75*g* in direction Z1. The engagement between the protrusion parts 65*b* through 65*e* and the slot parts 75*a* through 75*d*, which are at a center position, urges and elevates the blade part 65*a* in direction Z1 (See FIG. 7). As shown in FIGS. 8A and 8B, the fixed blade 65 is disposed in a manner flexing the planar spring members 75*e* through 75*g* and moving toward direction Z2. In this state, the urging force of the planar spring members 75*e* through 75*g* causes the blade part 65*a* of the fixed blade 65 to be pressed upward in direction Z1, thereby generating a blade force.

Figure 12:
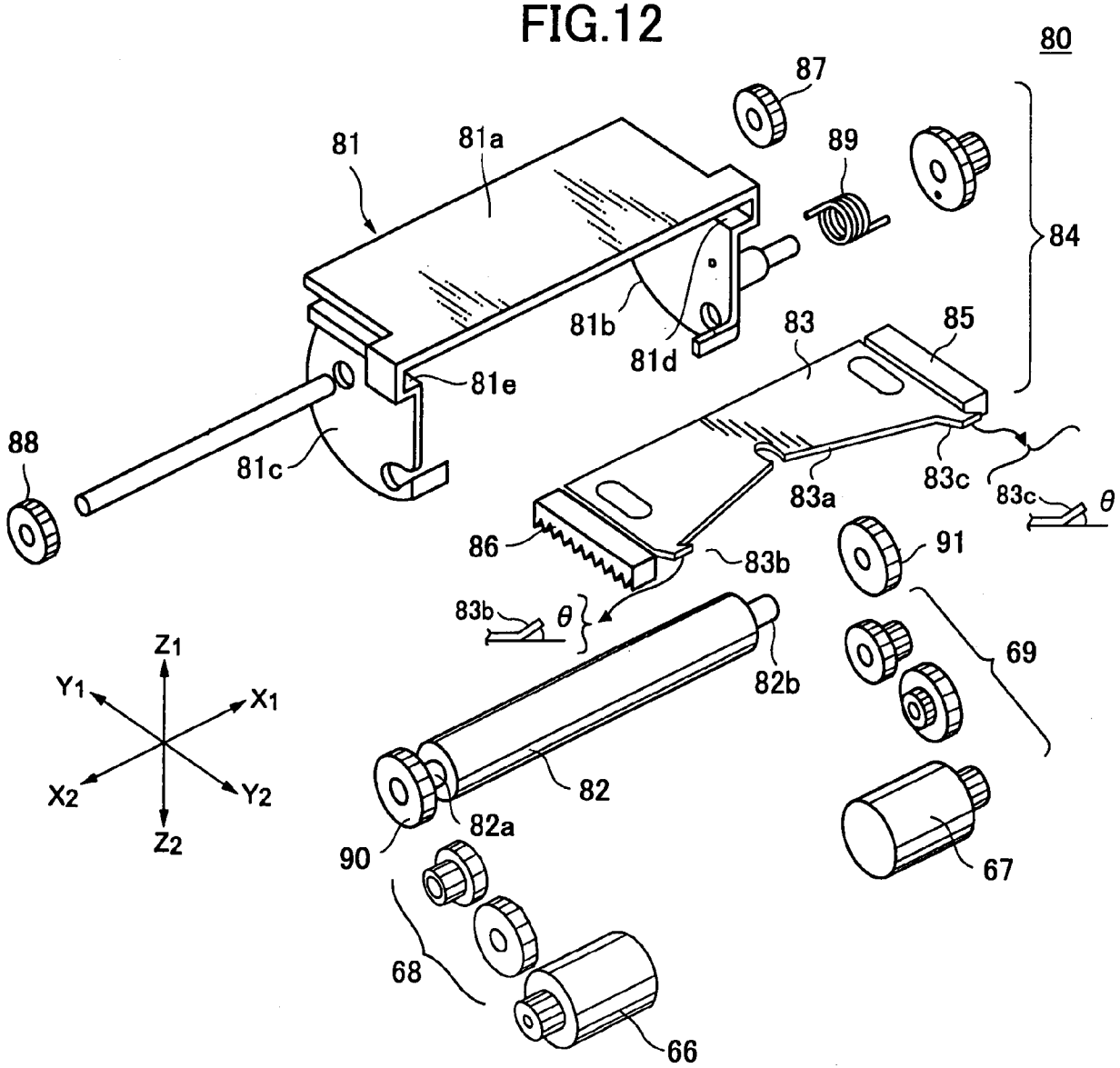
FIG. 12 is an exploded perspective view showing the second module according to an embodiment of the present invention.

FIG. 12 shows the first pulse motor 66 which provides a platen rotating function, and the second pulse motor 67 which provides a movable blade moving function. In the drawing, the first gear train 68 serves to transmit the rotation of the first pulse motor 66, and the second gear train 69 serves to transmit the rotation of the second pulse motor 67. As shown in FIG. 9, the lock members 70, 71 are disposed on the side toward X2 and X1, respectively. The lock member 70 and the lock member 71 move in synchronicity with each other, wherein the lock members 70, 71 are urged by a spring (not shown) in a clockwise direction as viewed in FIGS. 8A and 8B. The operation knob 73 is formed in a manner extending from the lock member 70.

Figure 11:
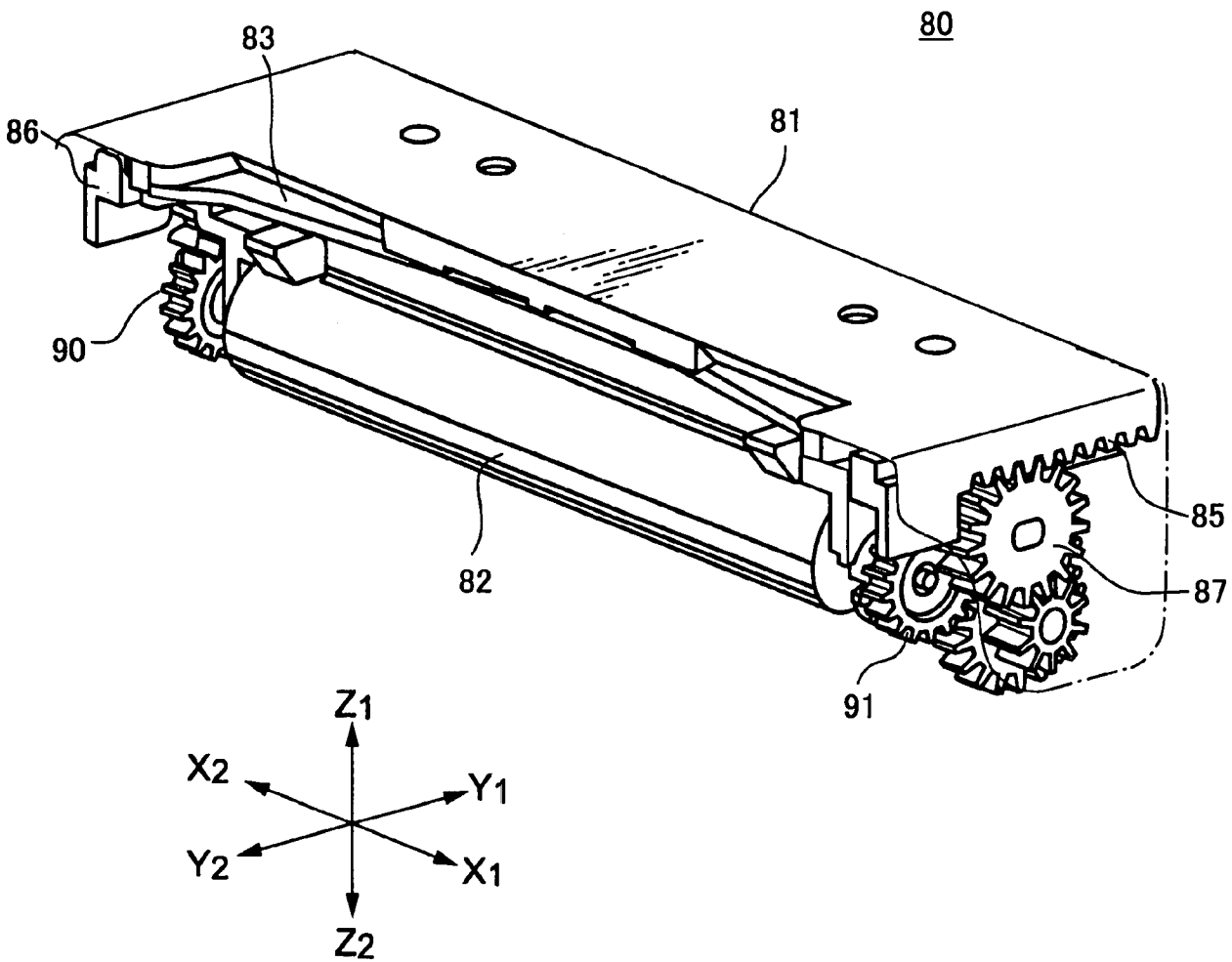
FIG. 11 is a perspective view showing a second module of the thermal printer apparatus according to an embodiment of the present invention.

As shown in FIGS. 11 and 12, the second module 80 includes a second support member 81 to which a platen roller 82, a movable blade 83, and a gear train 84, for example, are attached.

The platen roller 82 is supported between the flange parts 81*b* and 81*c* of the second support member 81.

With reference to FIGS. 11 and 12, the movable blade 83 has a V-shaped blade part 83*a*, and finger parts 83*b*, 83*c* disposed on each side of the blade part 83*a*. As shown in FIG. 12, the finger parts 83*b*, 83*c* each have a tip portion that is inclined θ degrees toward the direction Z1. Racks 85, 86 are fixed on each of the sides X1, X2 of the movable blade 83. The movable blade 83 is supported by guide parts 81*d*, 81*e* via the racks 85, 86, so that the movable blade 83 is able to move in directions Y1-Y2 but not in direction Z1. The rack 85 is engaged with a pinion 87, and the rack 86 is engaged with a pinion 88. The movable blade 83 is movable in direction Y1 by a spring member 89, and is drawn to a position below a ceiling part 81*a* of the second support member 81.

Figure 13A:
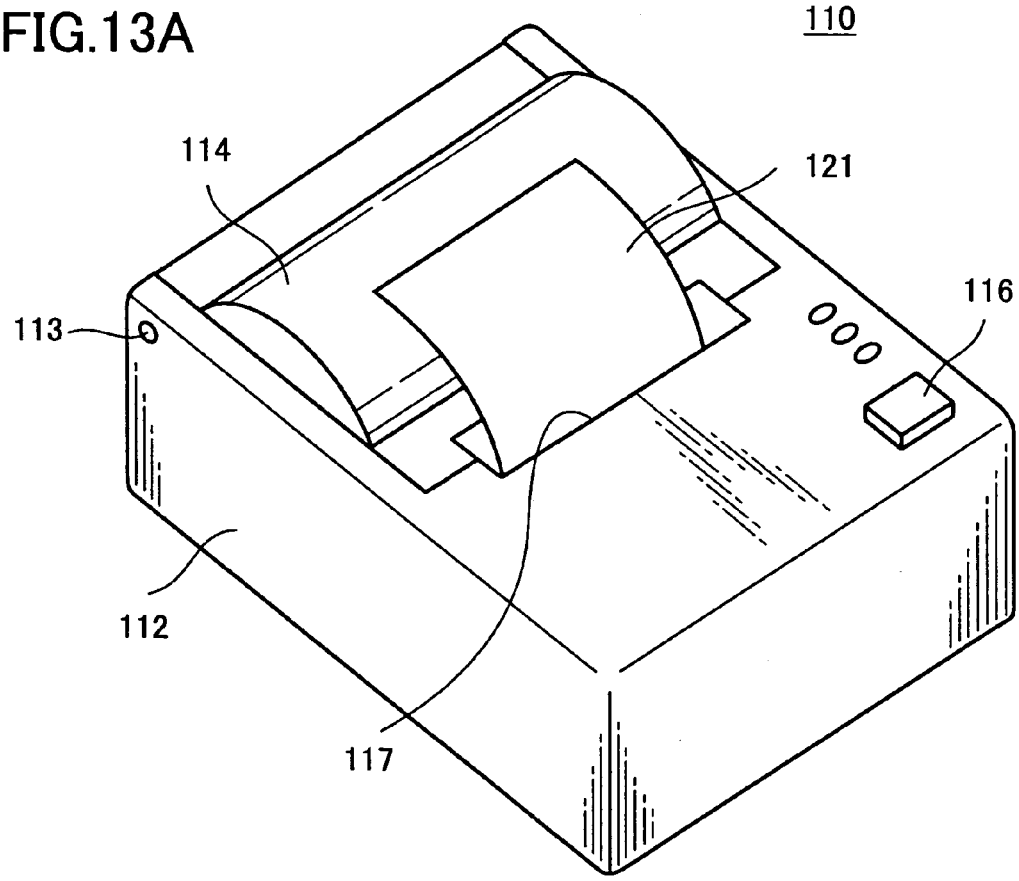
FIGS. 13A and 13B are schematic drawings showing a portable terminal assembled with the thermal printer apparatus shown in FIG. 4.
Figure 13B:
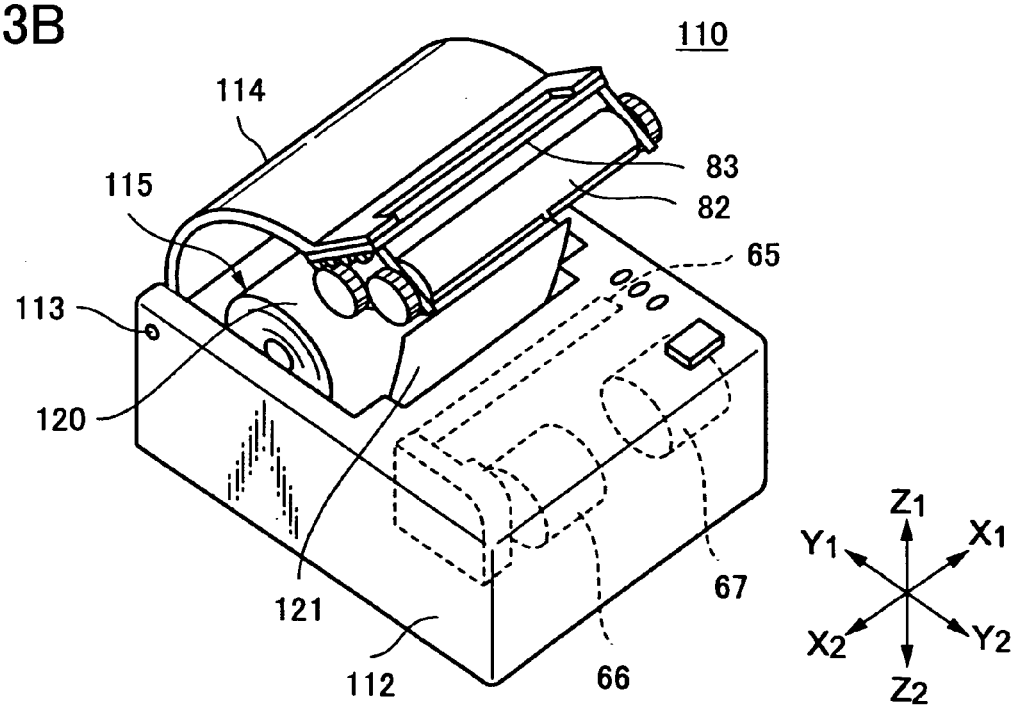
Figure 14:
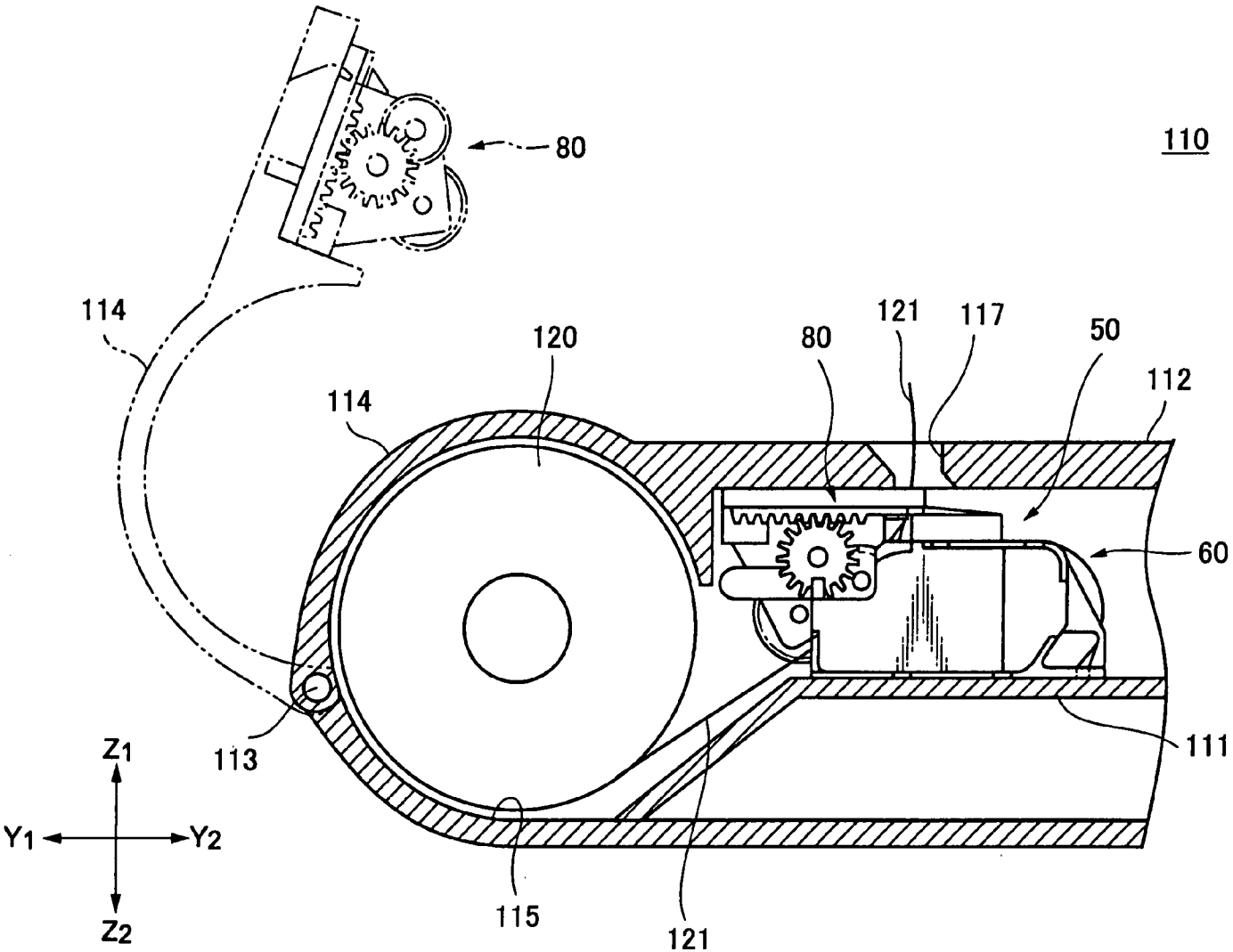
FIG. 14 is a schematic drawing showing a printer part of the portable terminal shown in FIG. 13.

Referring to FIGS. 13A, 13B, and 14, the above-described thermal printer apparatus 50 is assembled to a portable terminal 110. The portable terminal 110 has a chassis 111, a casing 112 covering the chassis 111, an openable lid 114 supported by an axis 113 and openable in direction Y1, a roll paper installment part 115 that extends from the axis 113 in direction Y1, and a operation button 116 disposed on the casing 112. The first module 60 is fixed on the chassis 111 in a manner facing the roll paper installment part 115. The second module 80 is fixed to a lower portion of a distal end part of the openable lid 114.

Figure 6:
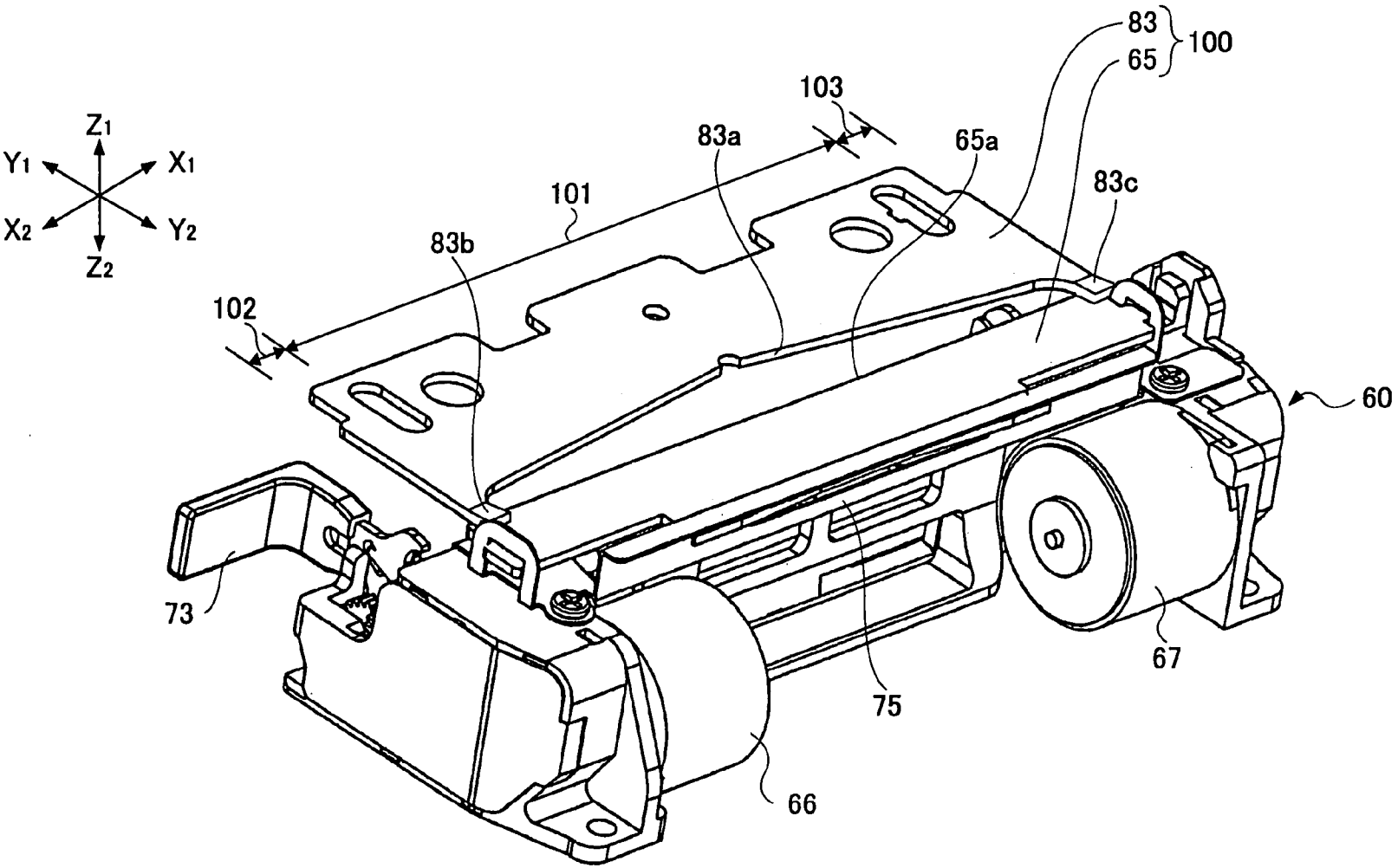
FIG. 6 is a schematic drawing for explaining a structure of a cutter of the thermal printer apparatus of FIG. 4.

As shown in FIGS. 13B and 14, the openable lid 114 is opened for installing a thermal paper roll 120 in the roll paper installment part 115. When the openable lid 114 is closed, the second module 80 becomes detachably attached to the first module 50, as shown in FIG. 13A and in solid lines in FIG. 14. That is, the lock members 70, 71 (FIGS. 7A-8B, 9) are depressed by axis parts 82*a*, 82*b*, of the platen roller 82 and then recover, so that the lock members 70, 71 become engaged (locked) with the axis parts 82*a*, 82*b*. In such state, the platen roller 82 presses a sheet of paper 121 against the thermal head 62, a gear 90 engages with a gear disposed at an end of the first gear train 68, and a gear 91 engages with a gear disposed at end of the second gear train 69 (See FIGS. 7B, 8B and 12). As shown in FIG. 6, by disposing the movable blade 83 and the fixed blade 65 in a position facing each other, an initial state of the cutter 100 is obtained. The paper 121 is passed through a portion of the cutter 100, and has its distal end projecting from an outlet 117.

Next, the formation of the cutter 100 is described. As shown in FIGS. 6 and 7B, in an initial position between the movable blade 83 and the fixed blade 65, the finger parts 83*b*, 83*c* of the movable blade 83 overlap with a portion of the fixed blade 65. This allows the movable blade 83 to travel above the fixed blade 65 when the movable blade 83 is moved in the direction Y2. The portions where the finger parts 83*b*, 83*c* of the movable blade 83 overlap with the fixed blade 65 are areas providing no cutting function (indicated, for example, with numerals 102, 103 in FIG. 6), and have no effect in cutting the paper 121.

Numeral 101 is an area providing a cutting function, that is, an area where the fixed blade 65 and the movable blade 83 provide a cutting function. The areas 102, 103 are situated on both outer sides of the area 101.

As shown in FIG. 7B, since the ends of the finger parts 83*b*, 83*c* are inclined θ degrees in direction Z1, the axis parts 82*a*, 82*b* are locked with the lock members 70, 71 so that the finger parts 83*b*, 83*c* are situated in a position almost contacting with the blade part 65*a* of the fixed blade 65. Numeral 105 indicates a gap between the finger parts 83*b*, 83*c* and the fixed blade 65.

Accordingly, in closing the openable lid 114 of the portable terminal 110, no excessive amount of pressing force is required to be applied to the openable lid 114, but rather an ordinary amount of force is needed for closing the openable lid 114 and engaging (locking) the axis parts 82*a*, 82*b* with the lock members 70, 71. This solves the problem of the openable lid 114 accidentally opening during operation of the thermal printer apparatus 50. In addition, the user of the portable terminal 110 will be able to recognize the engagement of the lock members 70, 71 with the axis parts 82*a*, 82*b* from his/her hand (clicking feel).

It is to be noted that the gap 105 is not required to be formed. That is, the finger parts 83*b*, 83*c* may alternatively contact with the blade part 65*a* of the fixed blade 65. In this case, also, the axis parts 82*a*, 82*b* can engage (lock) with the lock members without applying an excessive amount of pressing force to the openable lid 114.

By driving the thermal head 62, printing is performed on the paper 121. By driving the first pulse motor 66, the platen roller 82 is rotated via the first gear train 68 and the gear 90, thereby allowing the printed paper to be discharged. After the printing process is completed, the second pulse motor 67 is driven for deceleration via the second gear train 69, the pinions 87, 88 are rotated, the racks 85, 86 are driven, and the movable blade 83 (both sides of the movable blade 83 in the directions X1-X2) are moved in the direction Y2.

As shown in FIG. 8A, first, the blade part 65*a* of the fixed blade 65 is depressed in the direction Z2 when the inclined finger parts 83*b*, 83*c* abut the blade part 65*a* of the fixed blade 65. In this state, the planar spring parts 75*e* through 75*g*, being flexed, generate an urging force which causes the fixed blade 65 to urge in the direction Z1. This causes the blade part 65*a* of the fixed blade 65 to abut the blade part 83*a* of the movable blade 83, thereby generating a blade force.

Then, as shown in FIG. 8B, the movable blade 83 travels along the top surface of the fixed blade 65 so that the abutting relation between the blade part 83*a* of the movable blade 83 and the blade part 65*a* of the fixed blade 65 moves while maintaining the blade force, thereby cutting the paper 121.

In the step where the inclined finger parts 83*b*, 83*c* abut the blade part 65*a* of the fixed blade 65 for depressing the blade part 65*a* in direction Z2, a load greater than a prescribed amount is applied to the second pulse motor 67. However, the second pulse motor 67 will not cease nor prevent the cutter 100 from operating by using a pulse motor having a prescribed torque property as the second pulse motor 67.

After the paper 121 is cut, the second pulse motor 67 is reversely driven, and the movable blade 83 travels in the direction Y1 and returns to the position shown in FIG. 7B.

It is to be noted that the locked state between the second module 80 and the first module 60 can be released for separating the second module 80 from the first module 60 by operating the operation knob 73.

Next, another example of a cutter 100A is described.

Figure 15A:
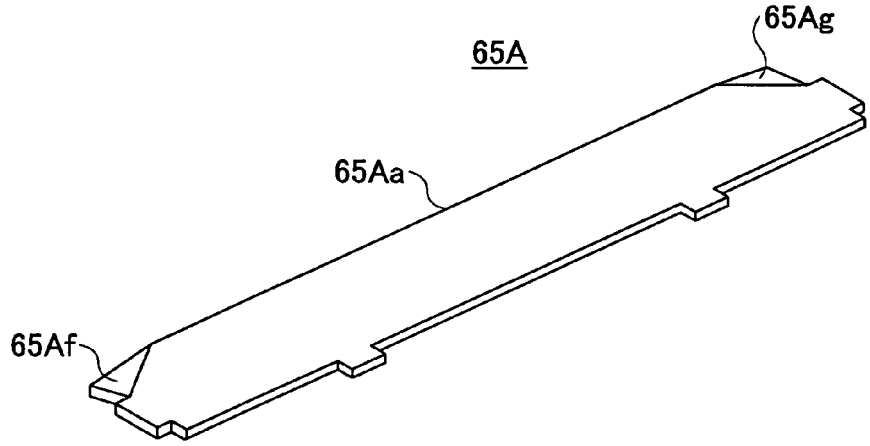
FIGS. 15A through 15C are schematic drawings showing a fixed blade according to an embodiment of the present invention.

In FIG. 15A, a fixed blade 65A has inclination portions 65Af, 65Ag disposed on the end parts (triangle area in FIGS. 15A and 17A) of a blade part 65Aa of the fixed blade 65A. The inclination portion 65Af is bent to form an inclination inclining toward direction Z2. Since the inclination portion 65Af is inclined, the blade part 83*a* of the movable blade 83 can more smoothly initiate traveling (moving) toward the position of abutting against the blade part 65Aa of the fixed blade 65A. The same applies to the inclination portion 65Ag disposed on the opposite side.

Figure 15B:
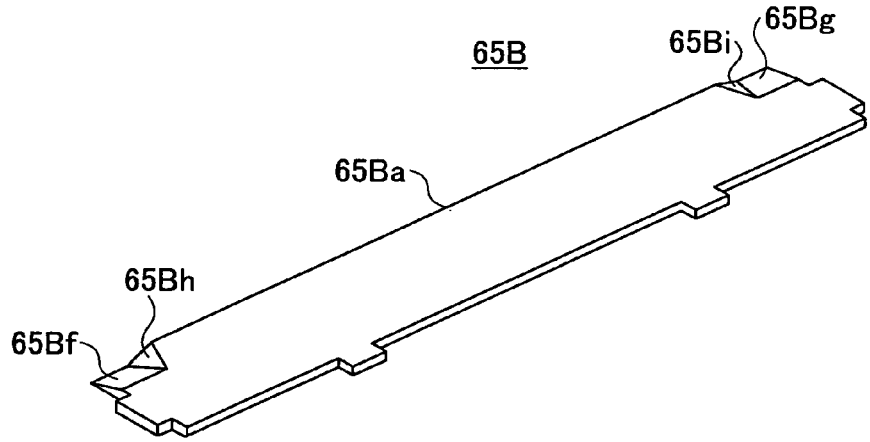

In FIG. 15B, a fixed blade 65B has inclination portions 65Bf, 65Bg disposed on the end parts of a blade part 65Ba of the fixed blade 65B. The inclination portion 65Bf is chamfered (ground) to form an inclination inclining toward direction Z2. Since the inclination portion 65Bf is inclined, the blade part 83*a* of the movable blade 83 can smoothly initiate traveling (moving) toward the position of abutting against the blade part 65Ba of the fixed blade 65B. The fixed blade 65 shown in FIG. 15C is a fixed blade where the end parts of its blade part 65*a* is not subjected to processing, such as bending or chamfering (grinding).

Figure 16A:
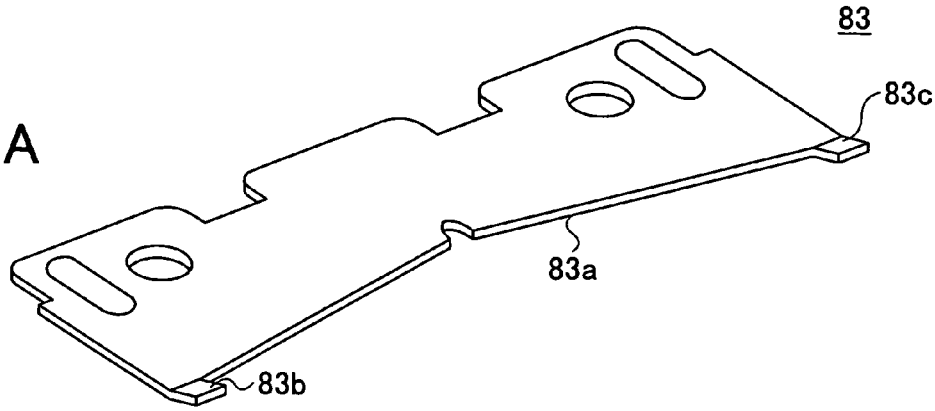
FIGS. 16A through 16C are schematic drawings showing a movable blade according to an embodiment of the present invention.

The movable blade 83 shown in FIG. 16A corresponds to the movable blade 83 shown in FIG. 6, in which the finger parts 83*b*, 83*c* have inclination portions formed by bending. The movable blade 83B shown in FIG. 16B has finger parts 83Bb, 83Bc disposed on both ends of its blade part 83Ba, in which the finger parts 83Bb, 83Bc have inclination portions 83Bb1, 83Bc1 (inclining in direction Z1) formed by chamfering (grinding). The movable blade 83C shown in FIG. 16C has finger parts 83Cb, 83Cc disposed on both ends of its blade part 83Ca, in which the finger parts 83Cb, 83Cc are not subjected to particular processing, such as bending or chamfering (grinding).

Figure 15C:
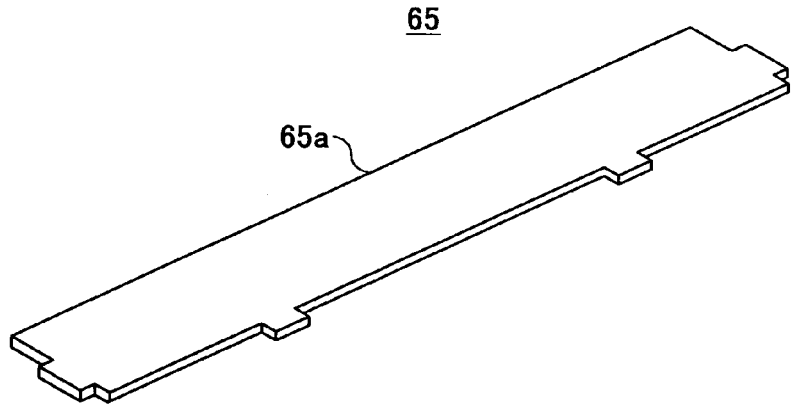
Figure 15C:
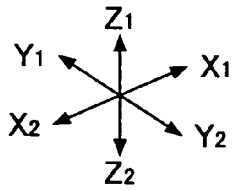
Figure 16B:
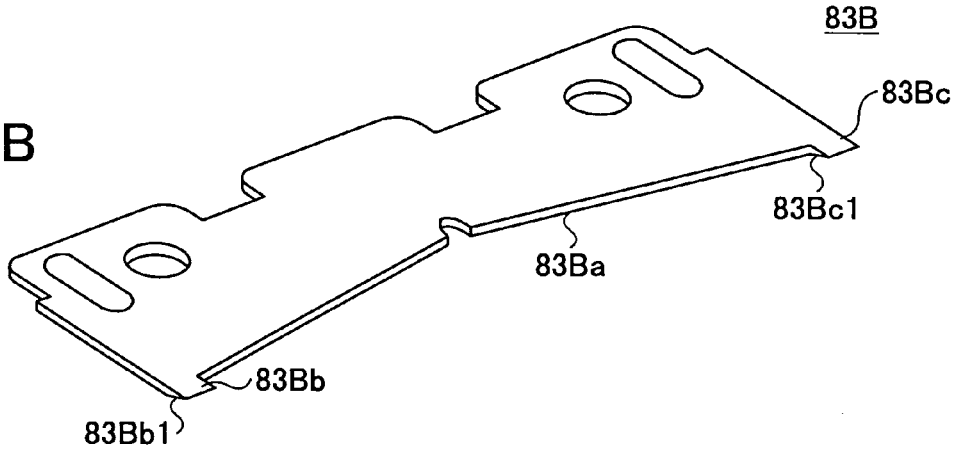
Figure 16C:
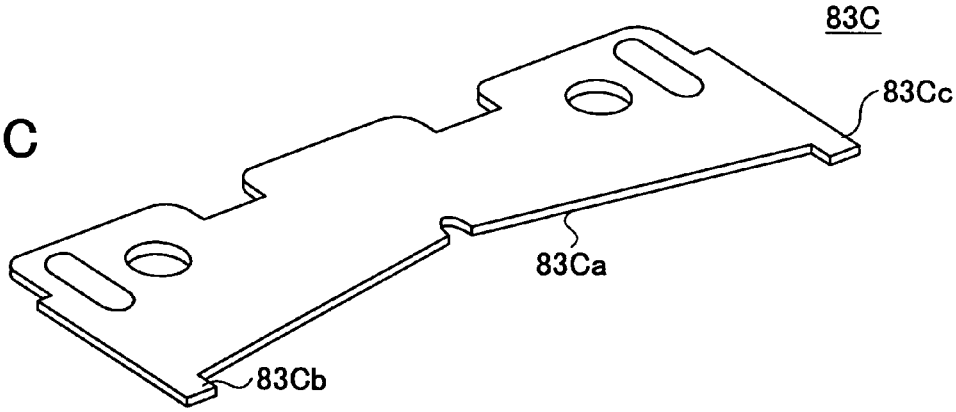
Figure 16C:
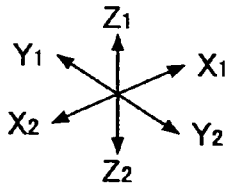

Cutters according to embodiments of the present invention (including cutters 100, 100A, 100B, 100C) are obtained by suitably combining the fixed blades 65A, 65B, 65 shown in FIGS. 15A through 15C with the movable blades 83, 83B, 83C shown in FIGS. 16A through 16C (except for a combination of the fixed blade 65 shown in FIG. 15C and the movable blade 83C shown in FIG. 16C in which no particular processing for forming inclinations is applied). The above-described cutter 100 shown in FIG. 6 is a combination of the fixed blade 65 shown in FIG. 15C and the movable blade 83 shown in FIG. 16A.

Figure 17A:
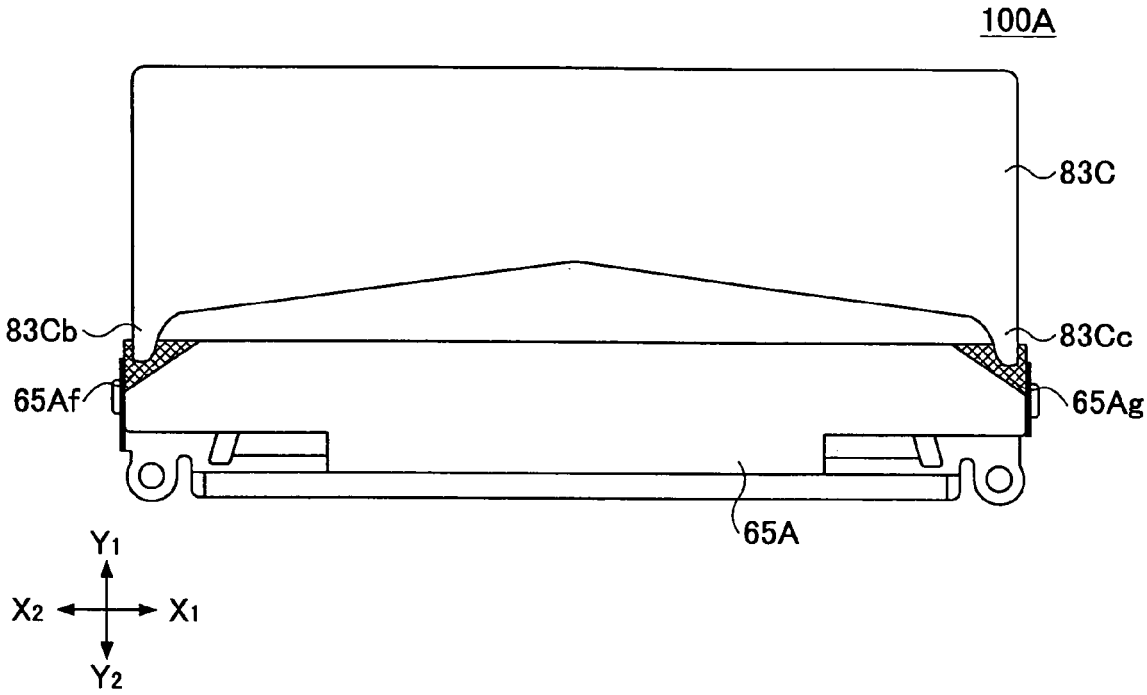
FIGS. 17A through 17C are schematic drawings showing a cutter according to another embodiment of the present invention.
Figure 17B:
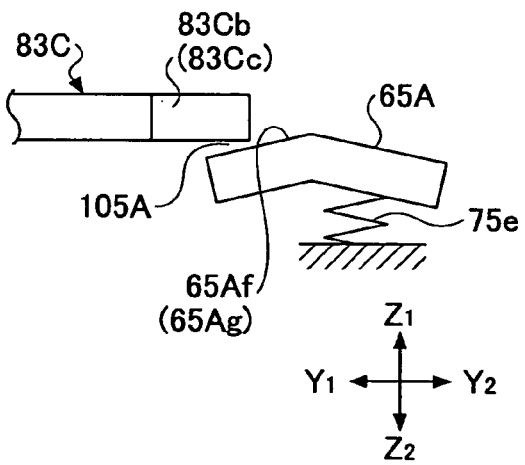
Figure 17C:
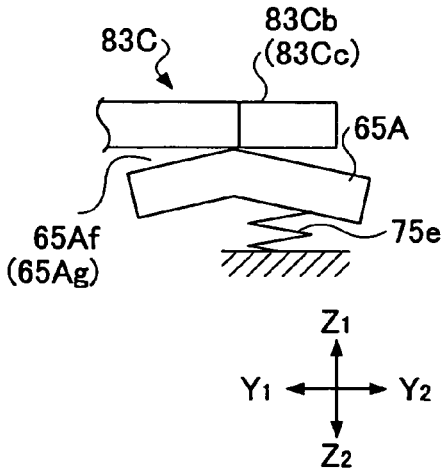

The cutter 100A shown in FIGS. 17A through 17C is a combination of the fixed blade 65A shown in FIG. 15A and the movable blade 83C shown in FIG. 16C. In the initial state shown in FIGS. 17A and 17B, the finger parts 83Cb, 83Cc are overlappingly disposed above inclination portions 65Af, 65Ag having a gap 105A therebetween. FIG. 17C shows a moved state of the movable blade 83C. In this state, the fixed blade 65A is depressed in the direction Z2 against the urging force of the planar spring part 75*e*, to thereby generate a blade force.

Figure 18A:
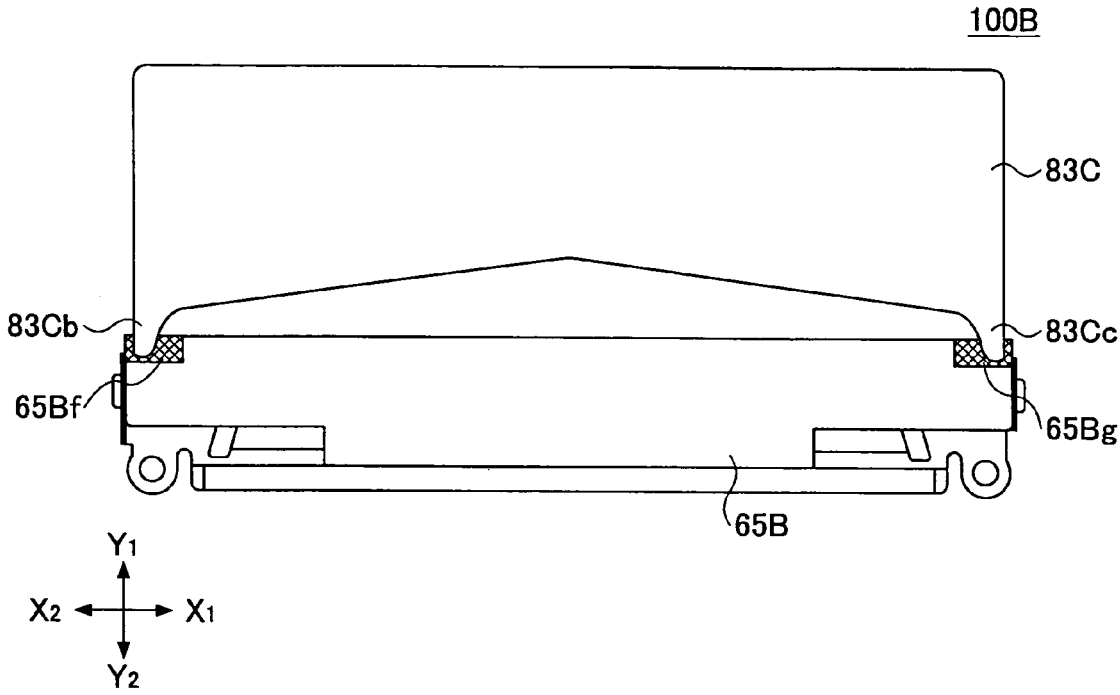
FIGS. 18A through 18C are schematic drawings showing a cutter according to yet another embodiment of the present invention.
Figure 18B:
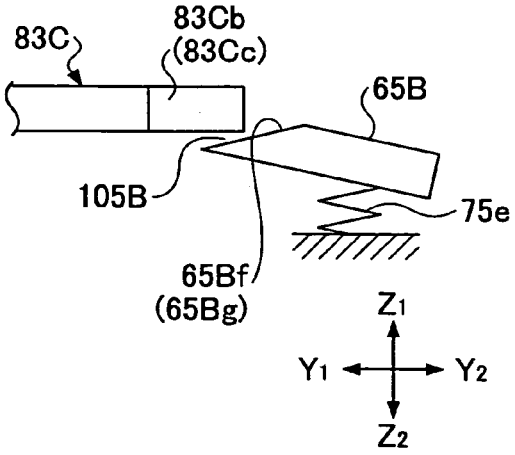
Figure 18C:
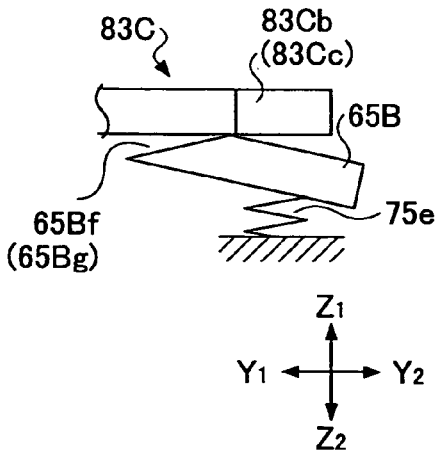

The cutter 100B shown in FIGS. 18A through 18C is a combination of the fixed blade 65B shown in FIG. 15B and the movable blade 83C shown in FIG. 16C. In the initial state shown in FIGS. 18A and 18B, the finger parts 83Cb, 83Cc are overlappingly disposed above the inclination portions 65Bf, 65B having a gap 105B formed therebetween. In this state, the fixed blade 65B is depressed in the direction Z2 against the urging force of the planar spring part 75*e*, to thereby generate a blade force.

Figure 19A:
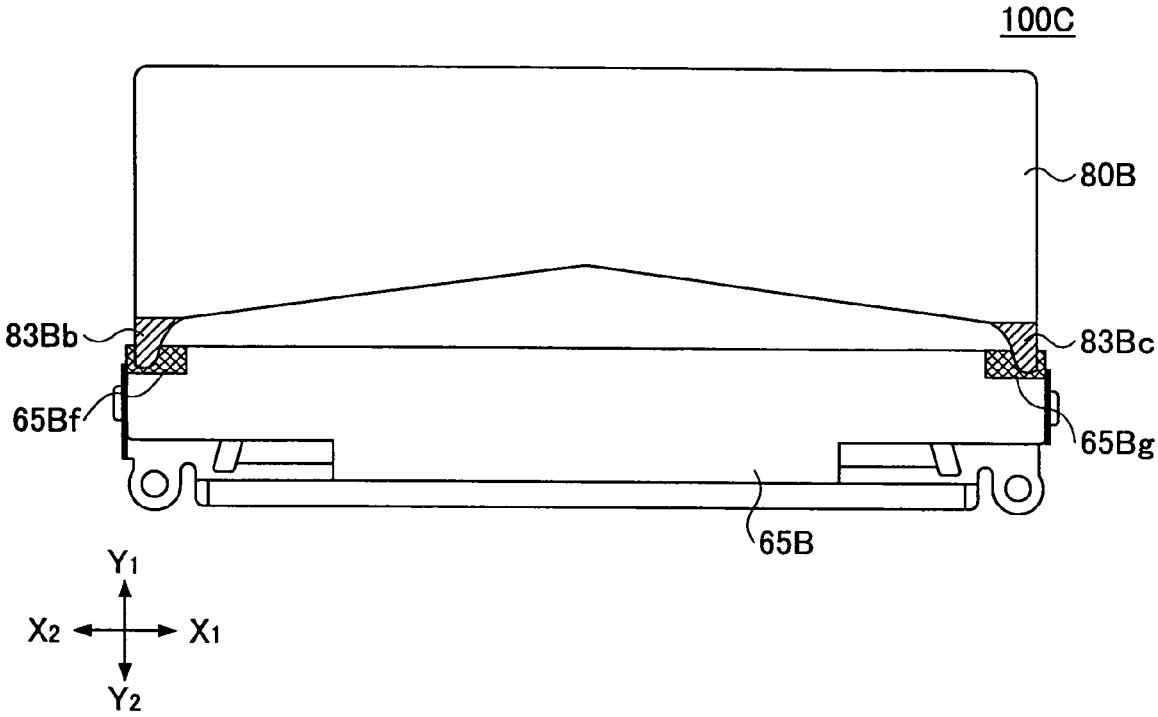
FIGS. 19A through 19C are schematic drawings showing a cutter according to a further embodiment of the present invention.
Figure 19B:
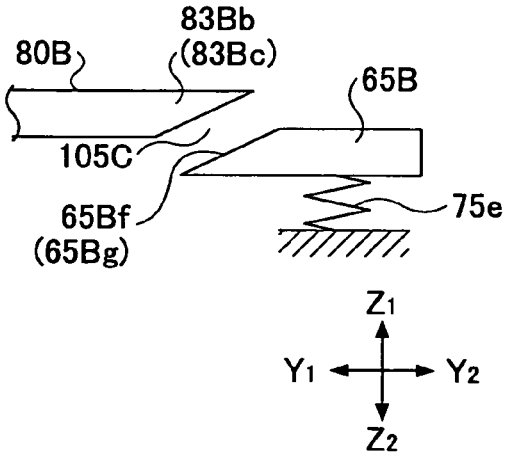
Figure 19C:
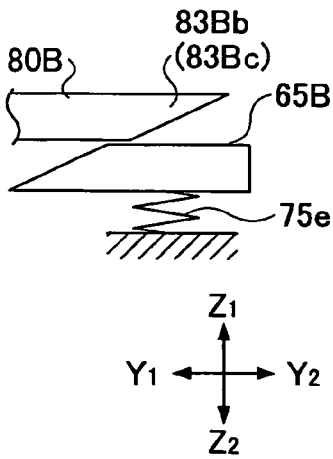

The cutter 100C shown in FIGS. 19A through 19C is a combination of the fixed blade 65B shown in FIG. 15B and the movable blade 83B shown in FIG. 16B. In the initial state shown in FIGS. 19A and 19B, the inclination portions of the finger parts 83Bb, 83Bc are disposed above the inclination portions 65Bf, 65B having a gap 105C formed therebetween. In this state, the fixed blade 65B is depressed in the direction Z2 against the urging force of the planar spring part 75*e*, to thereby generate a blade force.

In consequence, since at least one of the movable blade or the fixed blade has inclination portions inclining away from the oppositely disposed blade, the abutting force generated between the overlapped portions of the movable blade and the fixed blade can be reduced or eliminated when the first and second module is in the initial engaged (attached) state. Hence, the first and second modules of the printer apparatus can be engaged (locked), that is, the lid of the printer apparatus can be closed, without having to apply excessive force thereto. This prevents the lid from accidentally opening during a printing process. In addition, the user of the portable terminal installed with the printer apparatus will be able to easily recognize the engagement of the first and second modules from his/her hand (clicking feel).

Further, the present invention is not limited to these embodiments, but various variations and modifications may be made without departing from the scope of the present invention.

The present application is based on Japanese priority application No. 2004-083273 filed on Mar. 22, 2004, with the Japanese Patent Office, the entire contents of which are hereby incorporated by reference.

What is claimed is:

1. A printer apparatus comprising:

a first module including a fixed blade;

a second module including an openable lid and a movable blade mounted to the openable lid; and a locking mechanism for locking the first and second modules;

wherein the fixed blade and the movable blade each include an overlap portion that overlap with each other initially when the openable lid is closed by the locking mechanism locking the first and second modules from a detached state to an attached state, and wherein at least one of the overlap portion of the movable blade and the overlap portion of the fixed blade has an inclination portion, which inclination portion in the case of the overlap portion of the movable blade inclines away from the fixed blade, and in the case of the overlap portion of the fixed blade inclines away from the movable blade.

2. The printer apparatus as claimed in claim 1, wherein the inclination portion is formed by bending.

3. The printer apparatus as claimed in claim 1, wherein the inclination portion is formed by chamfering.

4. The printer apparatus as claimed in claim 1, wherein the inclination portion is formed by grinding.

5. The printer apparatus as claimed in claim 1, wherein a gap is provided between the overlap portion of the movable blade and the overlap portion of the fixed blade.

6. The printer apparatus as claimed in claim 1, wherein the overlap portion of the fixed blade has the inclination portion, and the inclination portion inclines away from the movable blade.

7. The printer apparatus as claimed in claim 1, wherein the overlap portion of the movable blade has the inclination portion, and the inclination portion inclines away from the fixed blade.

8. The printer apparatus as claimed in claim 1, wherein the overlap portion of the fixed blade and the overlap portion of the movable blade each has an inclination portion, wherein the inclination portion of the fixed blade inclines away from the movable blade, and the inclination portion of the movable blade inclines away from the fixed blade.

9. The printer apparatus as claimed in claim 1, wherein, when the first and second modules are detachably attached, the movable blade is movable with respect to the fixed blade from a first position at which the movable blade is spaced from the fixed blade and a second position at which the movable blade contacts the fixed blade and cooperates with a spring force exerted by the fixed blade to generate a blade force.

10. The printer apparatus as claimed in claim 9, wherein a pressing force required to attach the second module to the first module is unimpeded by the spring force exerted by the fixed blade.

* * * * *